United States Patent [19]

Phaal

[11] 4,203,732

[45] May 20, 1980

[54] METHOD OF MAKING AN ABRASIVE PRODUCT

[76] Inventor: Cornelius Phaal, Robant La., Edenburg, Rivonia, Sandton, Transvaal, South Africa

[21] Appl. No.: 554,699

[22] Filed: Mar. 3, 1975

[30] Foreign Application Priority Data

Mar. 7, 1974 [ZA] South Africa ..... 74/1477
May 24, 1974 [ZA] South Africa ..... 74/3328

[51] Int. Cl.[2] ..... C09K 3/14

[52] U.S. Cl. ..... 51/293; 51/298; 51/299; 51/308; 51/309; 264/108

[58] Field of Search ..... 51/295, 293, 298, 309, 51/299, 308; 264/108

[56] References Cited

U.S. PATENT DOCUMENTS

| | | | |
|---|---|---|---|
| 1,930,788 | 10/1933 | Buckner | 51/298 |
| 2,545,676 | 3/1951 | Small | 51/309 |
| 3,495,960 | 2/1970 | Schladitz | 51/298 |
| 3,573,013 | 3/1971 | Curn et al. | 51/293 |
| 3,664,819 | 5/1972 | Sioui et al. | 51/298 |
| 3,670,467 | 6/1972 | Walker | 51/293 |
| 3,694,177 | 9/1972 | Vereschagin et al. | 51/293 |
| 3,963,459 | 6/1976 | Vinard | 51/298 |

*Primary Examiner*—Donald J. Arnold
*Attorney, Agent, or Firm*—Cushman, Darby & Cushman

[57] ABSTRACT

The invention provides a method of making an abrasive product, e.g. a grinding wheel rim, which consists in providing a mixture of needle-shaped abrasive particles and the starter ingredients for a bonding matrix, causing the mixture to flow, preferably in a passage having a constriction, so causing the particles to orientate with their long axes substantially in the direction of flow, and allowing the mixture to set, at least partially.

5 Claims, 5 Drawing Figures

METHOD OF MAKING AN ABRASIVE PRODUCT

Figure 1:
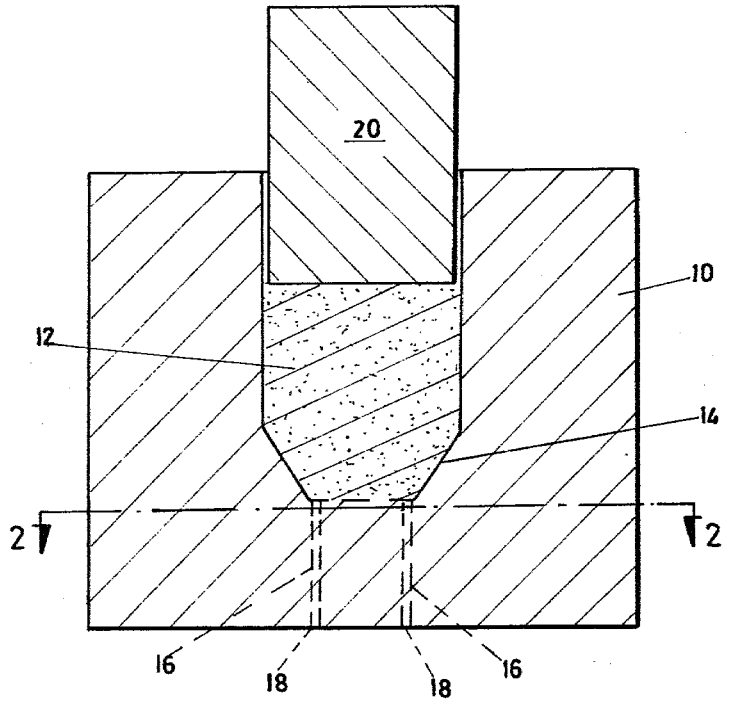

This invention relates to a method of making an abrasive product.

Abrasive tools having an abrading portion consisting of abrasive particles held in a bonding matrix are extensively used in industry. Such tools are, for example, grinding wheels, cutting tools and drills. A variety of abrasive particle may be used such as diamond, cubic boron nitride, alumina and silicon nitride. The type of abrasive particle which is selected will depend to a large extent on the nature of the abrading operation and the type of material being abraded. The bonding matrix will vary according to the tool and may, for example, be metal, resin, vitreous or rubber.

The abrasive particle which is employed in such tools will have a variety of shapes. Some of the particles, particularly in the case of synthetic diamond and cubic boron nitride, will have a substantially needle or columnar shape, i.e. they will have a long axis and a transverse short axis. In fact, certain processes have been proposed specifically directed to the production of needle shaped diamond particles. Mention in this regard may be made to U.S. Pat. No. 3,317,035 and South African patent application No. 73/7322. In the case of the latter application the method consists essentially in allowing the metal solvent necessary for diamond growth to penetrate a sleeve of graphite under temperatures and pressures suitable for diamond growth.

It has also been proposed to orientate needle-shaped particles in a bonding matrix by means of an impressed magnetic field. This method involves the use of particles having a magnetic coating and a non-magnetic bonding matrix and has the obvious disadvantage of being restricted to such particles and matrices.

According to this invention, there is provided a method of making an abrasive product including the steps of providing a mixture of needle-shaped abrasive particles and starter ingredients for a bonding matrix, causing the mixture to flow so causing the particles to orientate with their long axes substantially in the direction of flow, and causing the starter ingredients to set, at least partially.

Preferably, the mixture is caused to flow along a passage which has a constriction. The flow of mixture accelerates through the constriction and this assists in the orientation of the particles. The constriction is preferably provided by a narrowing of the passage and, in particular, by a narrowing of the cross-sectional area thereof.

The passage may also be provided with a bend which, when provided, may be a right angled bend.

In one particular arrangement the passage has a substantially right angled bend and is narrower in cross-sectional area downstream of the bend.

Flow along the passage may conveniently be achieved by means of pressure, e.g. in the form of a plunger acting in the passage. The mixture is usually in powdered form with the starter ingredients being of finer particle size than the abrasive particle. For example, in the case of metal matrices the metal powders for forming the matrix are generally less than 150 microns in size and the abrasive particles of the order of 150–350 microns width. In the case of resin matrices the powdered starter ingredients are generally less than 50 microns in size and the abrasive particle typically of the size 100–200 microns width. If the powdered mixture does not flow easily then heat, for example, may be applied to plasticize or liquefy the mixture and render it easily flowable.

The abrasive product produced by the method of the invention may be a rim of a grinding wheel or a segment for a grinding wheel rim, e.g. a cup grinding wheel rim. As is known, grinding wheels, e.g. resin bond grinding wheels, consist of a hub portion, and a peripheral grinding portion or rim. The peripheral grinding portion consists of abrasive particles held in a bonding matrix.

The method may be used to form the grinding wheel as a whole, i.e. the rim is bonded in situ to the hub portion, or used to make a rim or segment which is subsequently bonded to a hub portion.

In the case of rim production using flow through a passage, the passage preferably leads into a cavity defining the rim, the direction of mixture flow being substantially normal to the working face of the rim. In this way, the particles will be orientated with their long axes substantially normal to the working face of the rim which is advantageous particularly in the case of resin bond grinding wheels.

In the case of segments, these are preferably extruded through an orifice of predetermined shape and then cut to a desired size and shape. The method can be used with particular advantage in making segments for cup grinding wheel rims. Such segments can be produced with the long axes of the particles orientated substantially normal to the working face of the segment.

As mentioned above the method of the invention utilises needle shaped abrasive particles, i.e. particles which have a long axis and a transverse short axis. It is to be understood that in the case of diamonds and cubic boron nitride, the term "needle shaped" includes particles known in the art as "flats." Such particles have a generally flat appearance and normally have two large, flat surfaces, the dimensions of which are considerably greater than the thickness between the flat surfaces.

The needle shaped abrasive particles preferably have a ratio of long axis to transverse short axis of at least 3:1. In general, the long and short axes of the needle-shaped particles will be uniquely defined. However, if the axes are not uniquely defined, then one takes the long and short axes of greatest dimension when determining the above mentioned ratio.

The mixture may contain some abrasive particles which are not of needle-shape.

The abrasive particle is preferably diamond or cubic boron nitride.

The bonding matrix is preferably a resin and the particles are preferably metal coated, particularly when the bonding matrix is a resin. The metal coating, when provided, is preferably nickel and may be provided in an amount of from 30 to 80 weight percent, based on the coated particle.

The starter ingredients may be allowed only to set partially in which case complete setting will occur in a subsequent operation. Alternatively, the starter ingredients may be allowed to set completely to form the bonding matrix. For example, in the case of a resin or metal matrix a "green" product may be produced which is subsequently sintered to its final hard form.

Embodiments of the invention will now be described with reference to the accompanying drawings in which each of FIGS. 1 to 5 represents schematically apparatus for carrying out the method of the invention.

Figure 2:
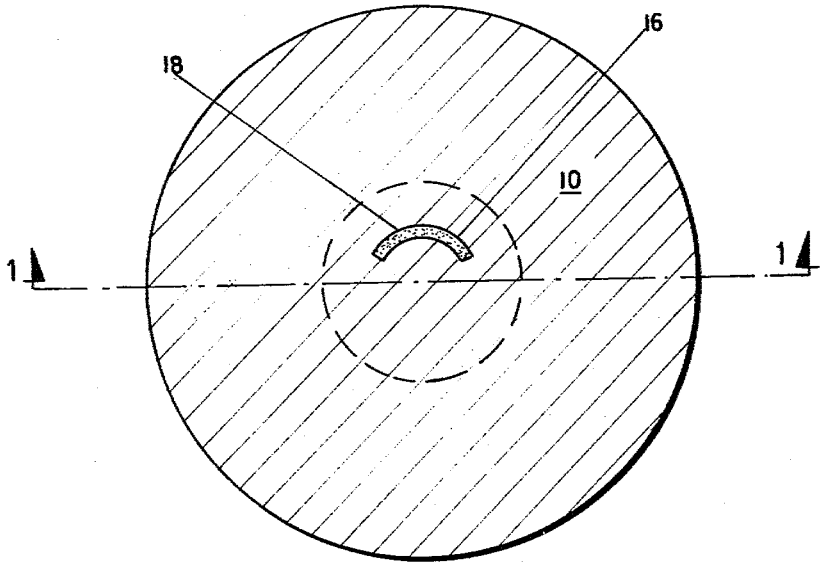

FIGS. 1 and 2 illustrate an apparatus for producing segments of a grinding wheel rim. FIG. 1 is a section along the line 1—1 of FIG. 2 and FIG. 2 is a section along the line 2—2 of FIG. 1. The apparatus consists of a body 10 having a passage 12 for receiving the abrasive particle/starter ingredients mixture. The passage 12 tapers at 14 and has an arcuate section 16 which terminates at opening 18. A plunger 20 acting in the passage 12, is provided. In use, the abrasive particle/starter ingredients mixture is placed in the passage 12 and a pressure is applied to this mixture by means of the plunger. This causes the mixture to flow in the passage and be extruded through the opening 18 in the form of an arcuate extrusion. This flow and extrusion of the mixture causes the needle shaped particles therein to orientate in the direction of flow and extrusion. The narrowing of the passage at the taper and in the arcuate section assists this orientation. The shape of the opening is so chosen and extruded product so cut as to produce a segment of any desired shape. In particular, segments for the rim of a cup grinding wheel may be produced in which the orientation of the particles is such that the long axes of the particles are substantially normal to the working faces of the segments.

Heat may be provided, e.g. in the arcuate section 16 to assist the flow of the mixture and/or to provide energy for the final setting or curing of the product.

Figure 3:
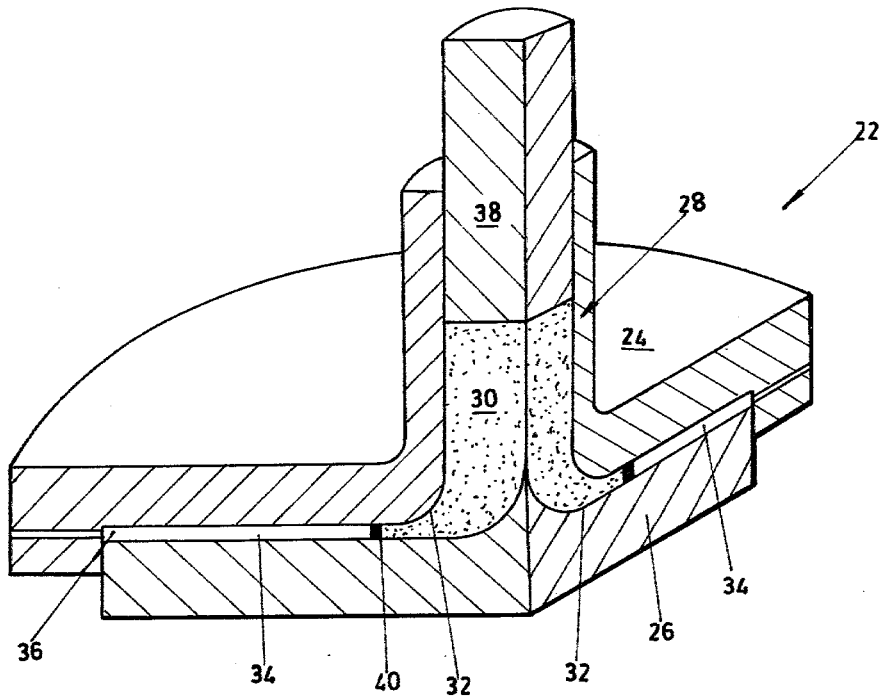

FIG. 3 illustrates schematically a section of apparatus for making an abrasive product using flow of the appropriate mixture along a passage. The apparatus comprises an annular body 22 having an upper section 24 and a lower section 26. The body has a passage 28 having a wide vertical section 30 narrowing after a substantially right-angled bend 32 to a narrow section 34. The narrow section 34 is open to atmosphere at 36. A plunger 38, acting in the wide section 30 of the passage, is provided. In use, an abrasive particle/starter ingredients mixture is placed in the wide section of the passage. A flexible element 40, for example made of rubber, is provided in the narrow section. The plunger is inserted into the wide section and used to apply a pressure to the mixture. This pressure is sufficient to force the element 40 along the narrow section and the mixture into this section. Flow of the mixture, and in particular, flow into the narrow section, causes the needle shaped abrasive particles of the mixture to orientate substantially in the direction of the flow.

Figure 4:
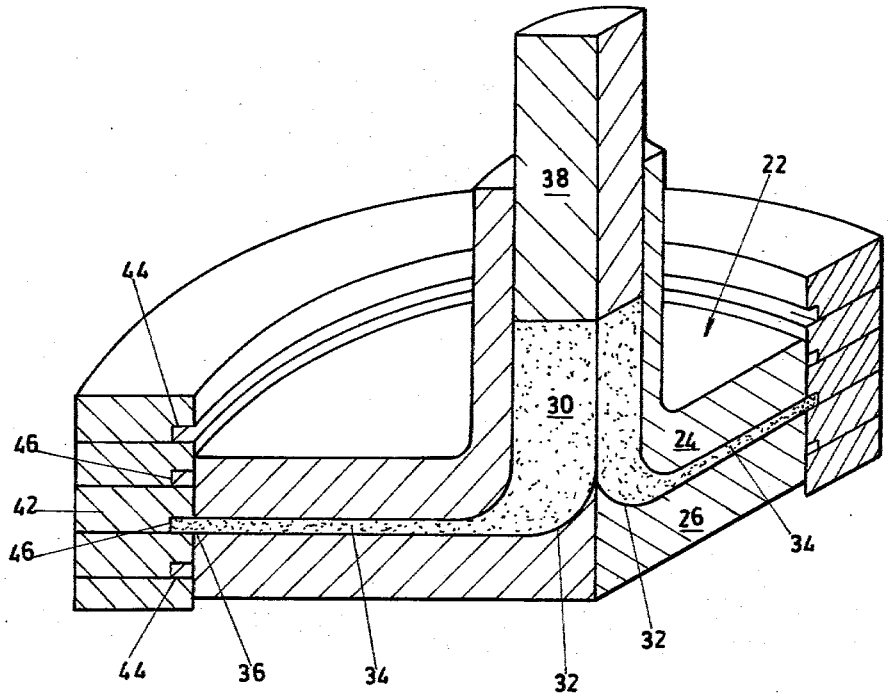

FIG. 4 illustrates apparatus, very similar to that of FIG. 3, in which rims for grinding wheels may be produced. Similar parts to those of FIG. 3 carry similar numbers. With this embodiment, layered annular body 42, movable in the vertical direction, is provided and has a plurality of cavities 44 each defining the rim of a grinding wheel. In use, one of the cavities 44 is positioned in register with the end 36 of narrow section 34 of the passage. No flexible element is provided and clearly this end is not open to atmosphere. The mixture, after flowing from the wide section into the narrow section, is forced into the rim-defining cavity 44. Faces 46 of the cavity defines the working face of the rim and so the direction of mixture flow is substantially normal to the face. Thus, orientation of the particles is also substantially normal to this face. After the cavity is suitably filled, the annular body 42 is raised or lowered to bring another, empty cavity into register with the narrow section. In this way a plurality of rims may be made.

Figure 5:
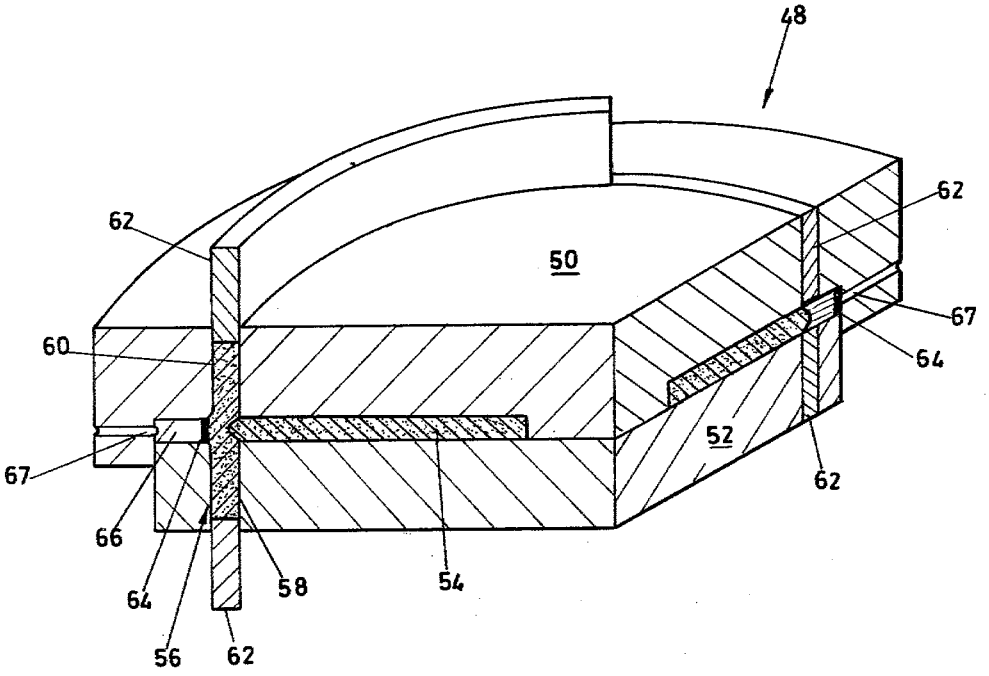

FIG. 5 illustrates a section of an apparatus for making a grinding wheel in which the rim is bonded, in situ, to the hub portion. The apparatus comprises an annular body 48 having an upper section 50 and a lower section 52. Sandwiched between the two sections 50 and 52 is the hub portion 54 of a grinding wheel. The body has a substantially T-shaped passage 56. Limbs 58 and 60 of the passage are, in use, filled with the abrasive particle starter ingredients mixture and plungers 62 are inserted therein. A flexible ring 64 prevents the mixture passing into the section 66 of the passage.

The rim portion of the grinding wheel is made by applying pressure to the mixture by means of the plungers 62. In the drawing, the left hand side shows the plungers before movement into the sections 58, 60 and the right hand side shows the plungers after movement. This is done only for illustration purposes as, clearly, in practice, the annular plungers will move as one. The mixture flows into the section 66 of the passage and in so doing the needle shaped particles of the mixture orientate substantially in the direction of flow. During this movement the flexible ring 64 is forced to the end 67 of the passage which is open to atmosphere. The compressed mixture, as illustrated on the right hand side of the drawing, bonds to the hub portion on setting and provides the rim of the grinding wheel. It is to be noted that the face of the rim adjacent the ring provides the working face and the needle shaped particles are orientated substantially normal to this face.

We claim:

1. A method of making an abrasive product including the steps of preparing a mixture of needle-shaped abrasive particles each having a long and a short axis and starter ingredients for a bonding matrix, flowing said mixture along a passage thereby orienting the abrasive particles such that the long axis of the abrasive particles are placed substantially in the direction of the flow, causing the mixture to flow from the passage into a product-defining cavity, such that the flow into the cavity is substantially normal to the wall of the cavity defining the working face of the product so that the abrasive particles are oriented substantially normally to the working face of the product and at least partially setting the starter ingredients of the bonding matrix in the cavity wherein the ratio of the long axes to a short axes of said abrasive particles is greater than 3:1, wherein the bonding matrix is selected from the group consisting of resin, metal, vitreous and rubber and wherein the abrasive particles are selected from the group consisting of diamond particles, cubic boron nitride particles and mixtures thereof.

2. A method according to claim 1 wherein the cavity defines the rim of a grinding wheel.

3. A method according to claim 1 wherein the passage has a constriction.

4. A method according to claim 3 wherein the constriction is provided by a narrowing of the cross-section of the passage.

5. A method according to claim 4 wherein the cavity defines the rim of a grinding wheel.

* * * * *